US008147029B2

(12) United States Patent
Suzuki

(10) Patent No.: US 8,147,029 B2
(45) Date of Patent: Apr. 3, 2012

(54) LIQUID EJECTION APPARATUS

(75) Inventor: Yoshihumi Suzuki, Ena (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 412 days.

(21) Appl. No.: 12/540,187

(22) Filed: Aug. 12, 2009

(65) Prior Publication Data

US 2010/0045728 A1 Feb. 25, 2010

(30) Foreign Application Priority Data

Aug. 25, 2008 (JP) ..... 2008-214890

(51) Int. Cl.
*B41J 2/165* (2006.01)
*B41J 29/38* (2006.01)

(52) U.S. Cl. ..... 347/23; 347/26; 347/35; 347/17

(58) Field of Classification Search ..... 347/17, 347/23, 26, 35
See application file for complete search history.

(56) References Cited

U.S. PATENT DOCUMENTS 4,668,965 A * 5/1987 Tanaka et al. ..... 347/23
5,493,319 A 2/1996 Hirabayashi et al.
2007/0257957 A1 11/2007 Takagi
2010/0123747 A1* 5/2010 McReynolds et al. ..... 347/14

FOREIGN PATENT DOCUMENTS

JP H04-257451 A 9/1992
JP 2002-178533 A 6/2002
JP 2003-123417 A 4/2003
JP 2007-268852 A 10/2007

* cited by examiner

*Primary Examiner* — Julian Huffman
(74) *Attorney, Agent, or Firm* — Baker Botts L.L.P.

(57) ABSTRACT

A liquid ejection apparatus includes a heater controller and a purge controller. The heater controller controls a heater to heat liquid in at least a part of a liquid path of a head when an ambient temperature of the head is lower than a first predetermined temperature. The purge controller controls a pressurizer so that: the pressurizer is continuously driven until a predetermined amount of liquid is ejected from ejection openings, when the ambient temperature is not lower than the first predetermined temperature; and the pressurizer is intermittently driven plural times until the predetermined amount of liquid is ejected from the ejection openings, when the ambient temperature is lower than the first predetermined temperature, an amount of liquid ejected from the ejection openings in response to a single driving action of the pressurizer being not larger than an amount of liquid heated by the heater.

6 Claims, 9 Drawing Sheets

LIQUID EJECTION APPARATUS

CROSS REFERENCE TO RELATED APPLICATION

This application claims priority from Japanese Patent Application No. 2008-214890, which was filed on Aug. 25, 2008, the disclosure of which is herein incorporated by reference in its entirety.

BACKGROUND OF THE INVENTION

1. Field of the Invention

The present invention relates to a liquid ejection apparatus which ejects liquid.

2. Description of Related Art

An inkjet recording apparatus is known, which prevents ink in a nozzle from thickening by purging, i.e. by pressurizing ink in an ink flow path of an inkjet head by a pump so as to forcibly eject the ink from the nozzle.

SUMMARY OF THE INVENTION

The above-described document fails to disclose purge control which is performed in accordance with the ambient temperature of the head. Provided that purging is carried out with the conditions employed when the ambient temperature is not lower than a predetermined temperature (e.g. 30° C. with which ink in the ink flow path of the head has desired viscosity) even if the actual ambient temperature is lower than the predetermined temperature, the purging is not properly done because the nozzle fails to eject a predetermined amount of ink. This is because the ink in the ink flow path of the head is cooled as the ambient temperature is low, with the result that the viscosity of the ink increases and the resistance to the ink from the path increases. It is possible to suitably conduct purging even when the ambient temperature is lower than a predetermined temperature, for example by using a high-pressure pump which is capable of applying high pressure on the ink, or by enlarging the cross section perpendicular to the ink flow in the ink flow path in order to restrain an increase of the resistance to the ink. However, in the former case the cost of the pump and the size of the head are increased. More specifically, a head capable of withstanding the pressure of the high-pressure pump must be large in size, and hence the entire apparatus must be large. The size of the head must be large also in the latter case.

Another conceivable method is such that a heater for heating the ink in the ink flow path is provided in the head and the resistance to the ink is decreased by heating the ink in the ink flow path by the heater so as to decrease the viscosity. However, the purged ink flowing from the outside of the head into the ink flow path of the head is cold and has high viscosity, and hence the resistance to the ink from the path is very high. Therefore the heater is incapable of properly achieve the desired effect, resulting in possible failure of purging.

An object of the present invention is to provide a liquid ejection apparatus which can properly conduct purging even when the ambient temperature is lower than a predetermined temperature, while the cost of a pressurizer and the enlargement of the head are restrained.

According to an aspect of the present invention, there is provided a liquid ejection apparatus including: a head which has a plurality of ejection openings from which liquid is ejected and a liquid path which is connected to the ejection openings and formed inside the head; a pressurizer which pressurizes liquid in the liquid path of the head; a temperature sensor which detects an ambient temperature of the head; a heater which heats liquid in at least a part of the liquid path; a heater controller which controls the heater so that the liquid is heated by the heater when the ambient temperature detected by the temperature sensor is lower than a first predetermined temperature; and a purge controller which controls the pressurizer so that (i) the pressurizer is continuously driven until a predetermined amount of liquid is ejected from the ejection openings, when the ambient temperature detected by the temperature sensor is not lower than the first predetermined temperature and (ii) the pressurizer is intermittently driven a plurality of times until the predetermined amount of liquid is ejected from the ejection openings, when the ambient temperature detected by the temperature sensor is lower than the first predetermined temperature, an amount of liquid ejected from the ejection openings in response to a single driving action of the pressurizer being not larger than an amount of liquid heated by the heater.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following will describe a preferred embodiment of the present invention with reference to figures.

Figure 1:
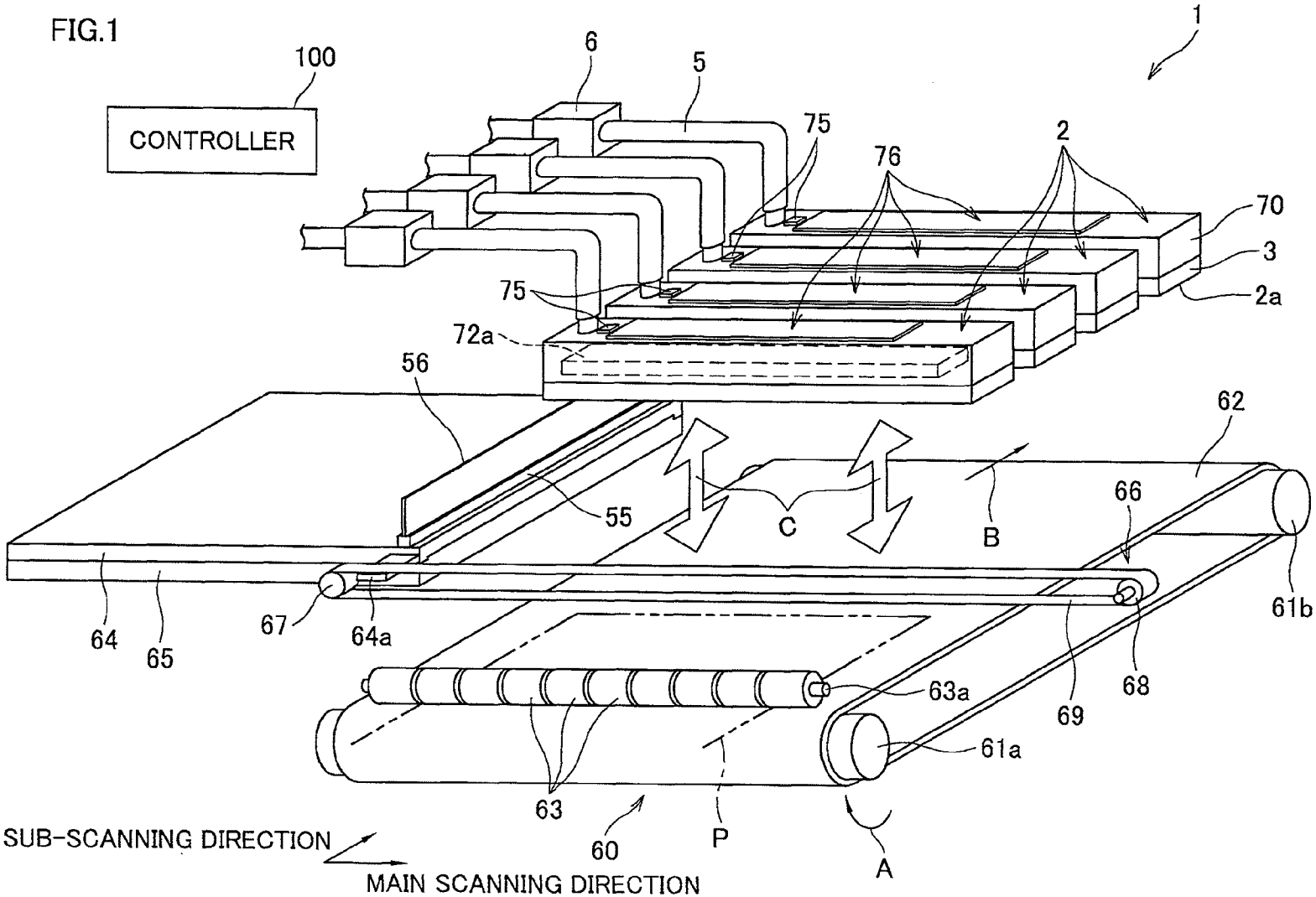
FIG. 1 is a perspective view of an ink jet printer of an embodiment of the present invention.

First, an inkjet printer 1 of an embodiment of the present invention is outlined with reference to FIG. 1. As shown in FIG. 1, the printer 1 is a color ink jet printer having four inkjet heads 2 ejecting four colors of ink (magenta, yellow, cyan, and black), respectively. The printer 1 includes a conveyor mechanism 60 which conveys sheets P and a controller 100 which controls the operations of the components of the printer 1.

The conveyor mechanism 60 includes a pair of belt rollers 61*a* and 61*b* and an endless conveyor belt 62 stretched between the rollers 61*a* and 61*b*. The rollers 61*a* and 61*b* both extend along the main scanning direction and are detached from each other in the sub-scanning direction. The roller 61*a* is a drive roller which is rotated in the direction indicated by the arrow A in FIG. 1 by a conveyor motor 58 (FIG. 7) which is under the control of the controller 100. As the roller 61*a* rotates, the conveyor belt 62 also rotates in the same direction. The roller 61*b* which is a driven roller rotates in accordance with the rotation of the conveyor belt 62. The outer surface of the upper part of the loop of the conveyor belt 62 functions as a conveying surface for conveying the sheets P in the conveyance direction B.

In the present embodiment, the sub-scanning direction is in parallel to the conveyance direction B, whereas the main scanning direction is perpendicular to the sub-scanning direction and in parallel to the conveying surface.

The conveyor mechanism 60 includes nip rollers 63 which are aligned on the shaft 63*a* extending in the main scanning direction. The shaft 63*a* is biased downward by a biasing mechanism (not illustrated), so that the nip rollers 63 are pressed onto the conveying surface of the conveyor belt 62. The nip rollers 63 are driven rollers which rotate in accordance with the movement of the conveyor belt 62.

The sheets P are conveyed by the conveyor mechanism 60 in the following manner. After the leading end of a sheet P reaches the point between the nip rollers 63 and the conveyor belt 62, the sheet P is conveyed in the conveyance direction B as the conveyor belt 62 moves, while the sheet P is sandwiched between the nip rollers 63 and the conveyor belt 62 and held on the conveying surface. On the conveying surface, this sheet P serially passes the positions which oppose the ejection surfaces 2*a* of the heads 2, respectively.

The heads 2 each being substantially rectangular in shape and long in the main scanning direction are disposed at predetermined intervals in the sub-scanning direction. The four heads 2 are fixed to a frame (not illustrated) which is fixed to the housing of the printer 1. In short, the printer 1 is a line-type printer.

The upper surface, i.e. the printing surface of the sheet P receives the ink with different colors which is serially ejected from the ejection surfaces 2*a* of the respective heads 2 as the sheet P passes the regions immediately below the respective heads 2, with the result that a desired color image is formed on the printing surface of the sheet P.

Now, the heads 2 are detailed with reference to FIG. 2.

Figure 3:
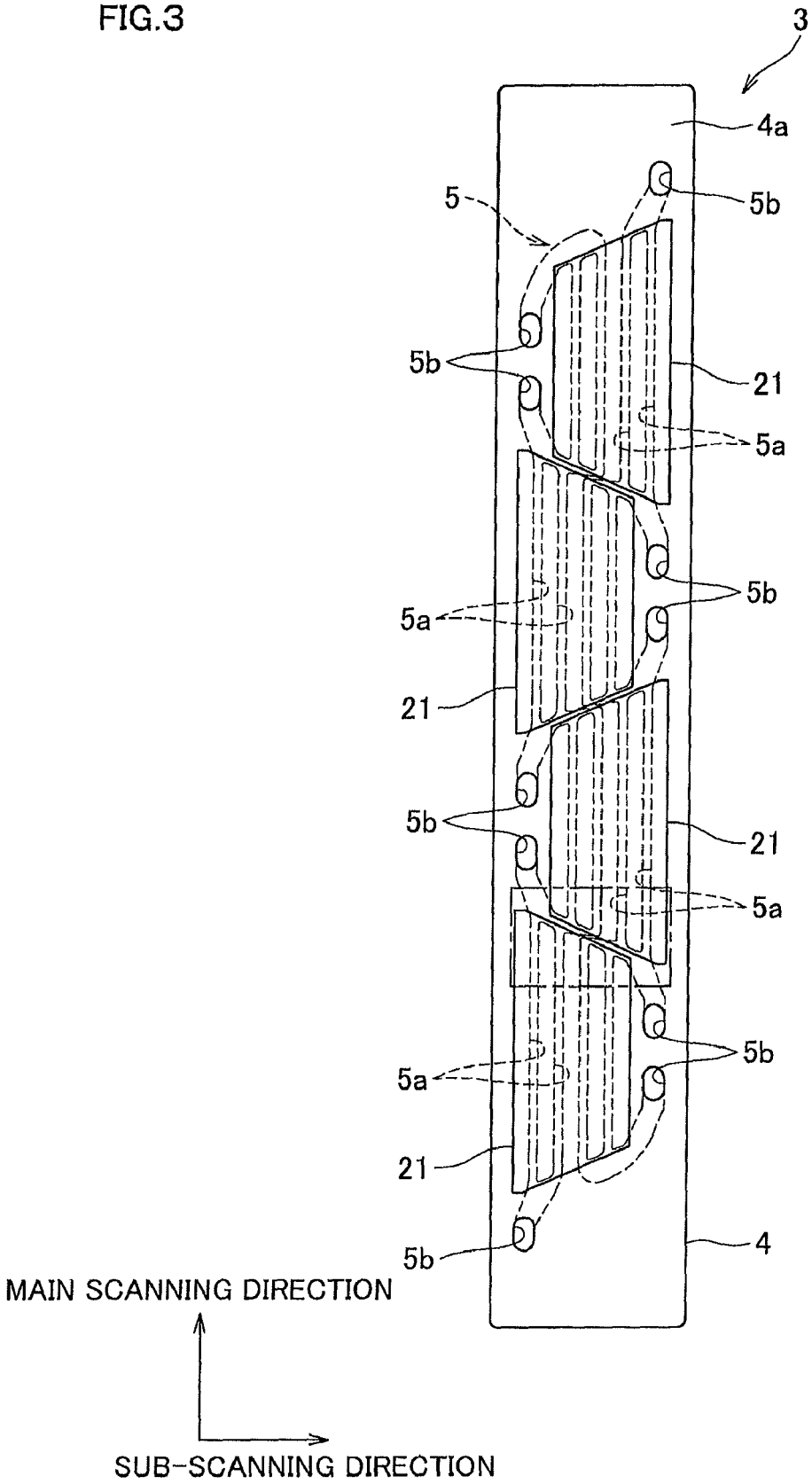
FIG. 3 is a plan view of the head main body of the head.

Each of the heads 2 includes a head main body 3 and a reservoir unit 70 which is fixed to the upper surface of the head main body 3. The head main body 3 includes a path unit 4 which is substantially rectangular in shape and long in the main scanning direction as shown in FIG. 1 and four actuator units 21 which are joined to the upper surface 4*a* of the path unit 4 by an adhesive agent as shown in FIG. 3. The lower surface of the path unit 4 functions as an ejection surface 2*a* having ejection openings 8 from which ink is ejected. The reservoir unit 70 supplies ink to the path unit 4 and is substantially rectangular in shape and long in the main scanning direction in the same manner as the path unit 4 of the head main body 3, as shown in FIG. 1. Among the components of the head 2, the reservoir unit 70 and the path unit 4 of the head main body 3 have paths therein. The ink flow path of the head 2 is composed of the paths in the reservoir unit 70 and the path unit 4.

Fixed to the upper surface of the actuator unit 21 is one end and its adjacent part of a COF (Chip On Film) 50. The COF 50 is a flexible substrate on which a driver IC (not illustrated) is mounted. The other end of the COF 50 is electrically coupled with a control substrate (not illustrated). The control substrate controls the actuator unit 21 via a driver IC. The driver IC generates a drive signal to drive the actuator unit 21.

The reservoir unit 70 is formed by stacking and fixing three rectangular metal plates 71-73. Inside the reservoir unit 70 formed are an inflow path 71*a*, a reservoir 72*a*, and 10 outflow paths 73*a* which are linked to one another. FIG. 2 illustrates only one outflow path 73*a*. The inflow path 71*a* is connected to one end of a flexible tube 5. The other end of the tube 5 is connected to an ink tank (not illustrated). The ink in the ink tank therefore flows into the inflow path 71*a* via the tube 5. In the middle of the tube 5 provided is a pressure pump 6 (see FIG. 1). The pressure pump 6 operates under the control of the controller 100. The pressure pump 6 pressurizes the ink in the ink flow path of the head 2 by forcibly supplying the ink from the ink tank toward the head 2.

The reservoir 72*a* temporarily stores the ink supplied through the inflow path 71*a*. The reservoir 72*a* extends in the main scanning direction (see FIG. 1), and has the largest capacity among the paths constituting the ink flow path of the head 2. The path inside the reservoir unit 70, which runs from the inflow path 71*a* to the outflow paths 73*a* via the reservoir 72*a*, has the lowest resistance to the ink among the paths constituting the ink flow path of the head 2.

The lower surface of the plate 73 is uneven so that gaps are formed between the lower surface and the COF 50. A convex part on the lower surface of the plate 73 has the opening of the outflow path 73*a* and is fixed to the upper surface 4*a* of the path unit 4. The reservoir 72*a* is connected to a supply opening 5*b* of the path unit 4 via the outflow path 73*a*, and hence the reservoir 72*a* is linked to the ink flow path in the path unit 4. This allows the ink in the ink tank to pass through the inflow path 71*a*, the reservoir 72*a*, and the outflow path 73*a* in this order and reach the path unit 4 via the supply opening 5*b*.

The upper surface of the reservoir unit 70 is provided with a temperature sensor 75 and a heater 76 (see FIG. 1). The temperature sensor 75 is located between one end of the tube 5 and the heater 76. The temperature sensor 75 detects the ambient temperature of the head 2 and sends a detection signal to the controller 100. The heater 76 extends in the main scanning direction and is substantially as wide as the reservoir 72*a* in the sub-scanning direction. The heater 76 receives electricity and generates heat under the control of the controller 100. The plate 71 is heated by the heater 76, so that the entire ink in the reservoir 72*a* is heated.

Figure 4:
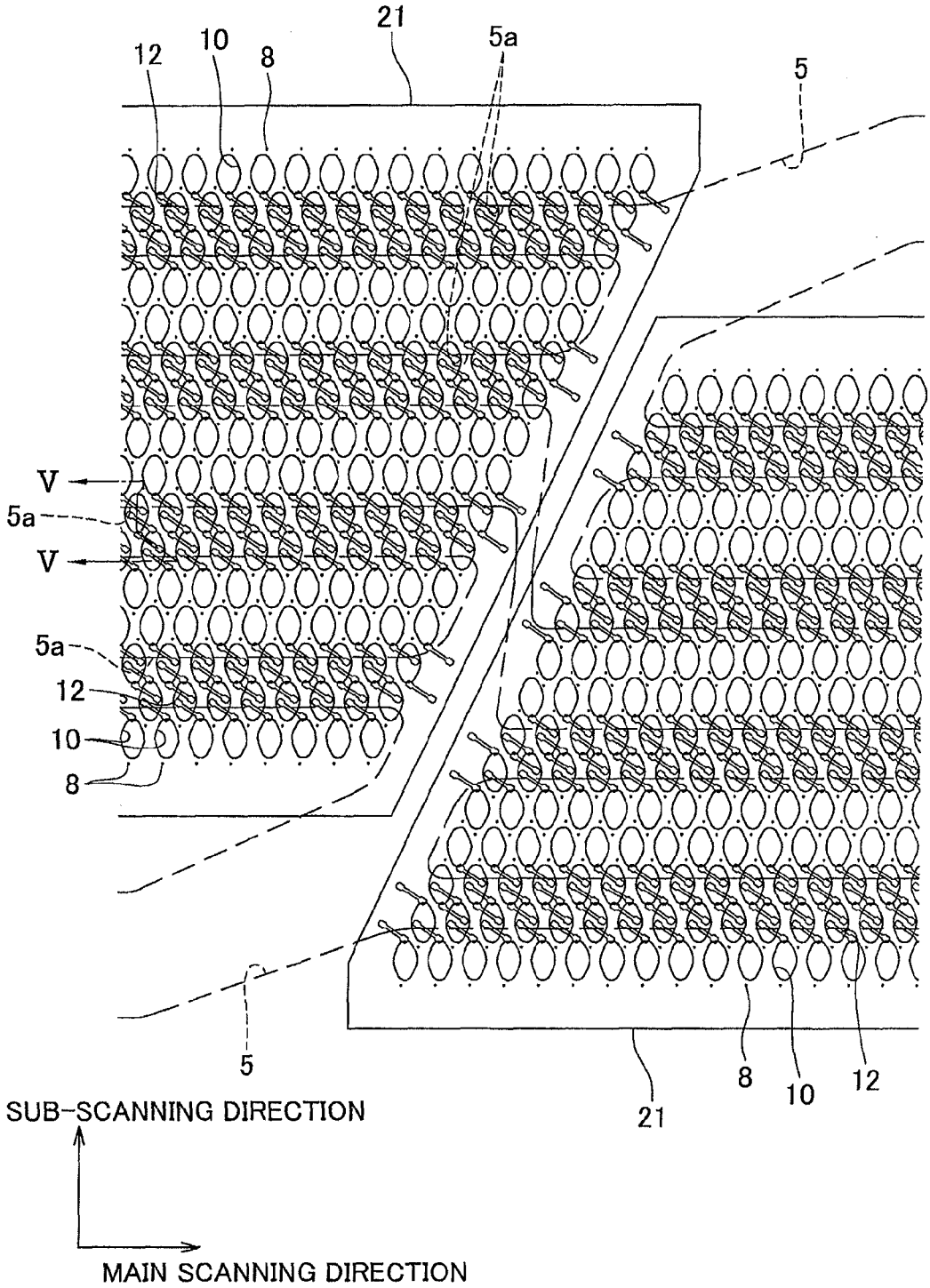
FIG. 4 is an enlarged view of the region circled by the dashed line in FIG. 3.

Now, referring to FIGS. 3-6, the head main body 3 will be described. In FIG. 4, the pressure chamber 10, an aperture 12, and an ejection opening 8 are drawn with full lines, even if these components are usually drawn with dotted lines as they are under the actuator units 21.

Figure 2:
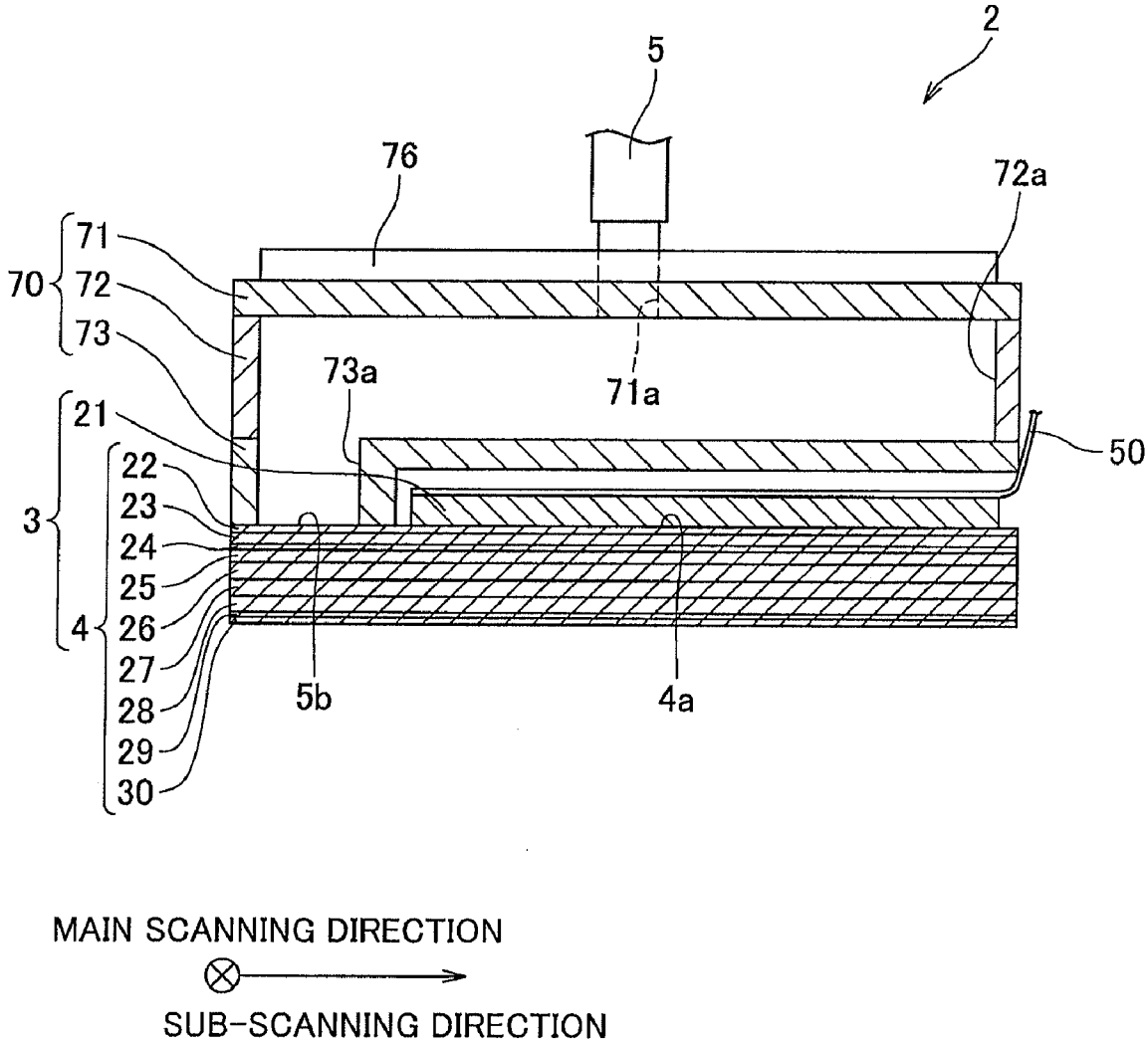
FIG. 2 is a cross section of a head in the printer.
Figure 5:
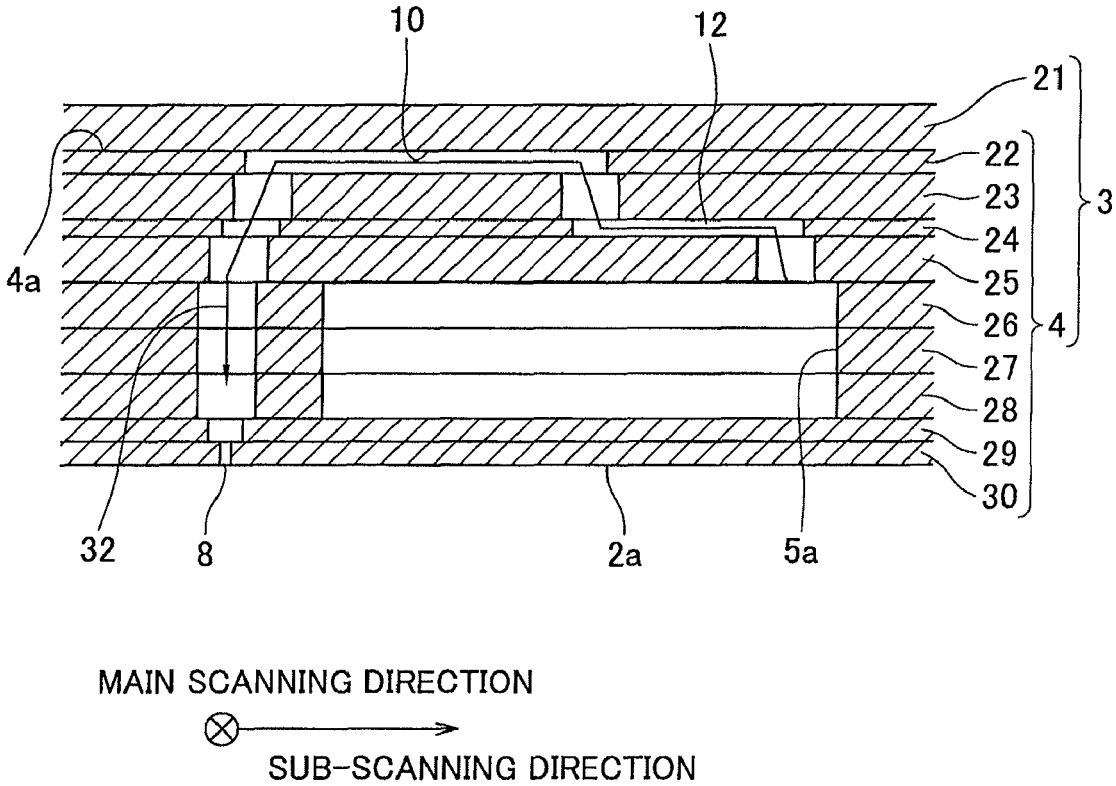
FIG. 5 is a cross section taken at V-V line in FIG. 4.

The upper surface 4*a* of the path unit 4 has, as shown in FIG. 3, 10 supply openings 5*b* corresponding to the outflow paths 73*a* of the reservoir unit 70 (see FIG. 2). Furthermore, the upper surface 4*a* has pressure chambers 10 formed in a matrix manner as shown in FIG. 4. As shown in FIGS. 4 and 5, the ejection surface 2*a* which is the lower surface of the path unit 4 has ejection openings 8 which are formed in a matrix manner in the same way as the pressure chambers 10. Inside the path unit 4 formed are manifold paths 5 extending from the supply openings 5*b*, sub-manifold paths 5*a* branching from the manifold paths 5, and individual ink flow paths 32 (see FIG. 5). The manifold paths 5 and the sub-manifold paths 5*a* are linked to the reservoir 72*a* via the supply openings 5*b*. These paths are ink flow paths shared among the pressure chambers 10 and the ejection openings 8. The individual ink flow paths 32 correspond to the respective pressure chambers 10 and ejection openings 8. Each of the paths 32 connects the end of the sub-manifold path 5*a* with the ejection opening 8 via the aperture 12 functioning as a throttle and the pressure chamber 10. The pressure chamber 10 is blocked by the actuator unit 21 which is fixed to the upper surface 4*a* of the path unit 4.

As shown in FIG. 4, the pressure chambers 10 are provided at equal intervals in the main scanning direction, in arrangement areas of the actuator units 21. The pressure chambers 10 form 16 lines along the main scanning direction. Comparing any two neighboring lines, the number of pressure chambers 10 in the line close to the bottom of the actuator unit 21 is larger than the number of pressure chambers in the line far from the bottom. The same applies to the ejection openings 8.

As shown in FIG. 5, the path unit 4 includes, from the top to the bottom, a cavity plate 22, a base plate 23, an aperture plate 24, a supply plate 25, three manifold plates 26, 27, and 28, a cover plate 29, and a nozzle plate 30. These nine metal plates are made of stainless steel or the like. The plates 22-30 are rectangular in shape and long in the main scanning direction. These plates 22-30 are aligned, stacked, and fixed, with the result that the manifold paths 5, the sub-manifold paths 5*a*, and individual ink flow paths 32 are formed inside the path unit 4.

The flow of ink in the path unit 4 will be discussed. The ink supplied from the reservoir unit 70 via the supply openings 5*b* to the path unit 4 flows from the manifold paths 5 to the sub-manifold paths 5*a*, and then diverged from the sub-manifold paths 5*a* to the individual ink flow paths 32. In the individual ink flow paths 32, the ink reaches the ejection openings 8 via the apertures 12 and the pressure chambers 10. Each aperture 12 is a part of the individual ink flow path 32, and the resistance to the ink is the highest in the aperture 12 among the paths constituting the ink flow path of the head 2, except the nozzles constituting the ejection opening 8.

The actuator units 21 will now be discussed. As shown in FIG. 3, each actuator unit 21 has a trapezoidal shape in a plan view. The actuator units 21 are arranged in a zigzag pattern in the main scanning direction not to overlap the supply openings 5*b*. The parallel sides of each actuator unit 21 extend in the main scanning direction, whereas the oblique sides of neighboring actuator units 21 overlap each other in the main scanning direction.

Figure 6A:
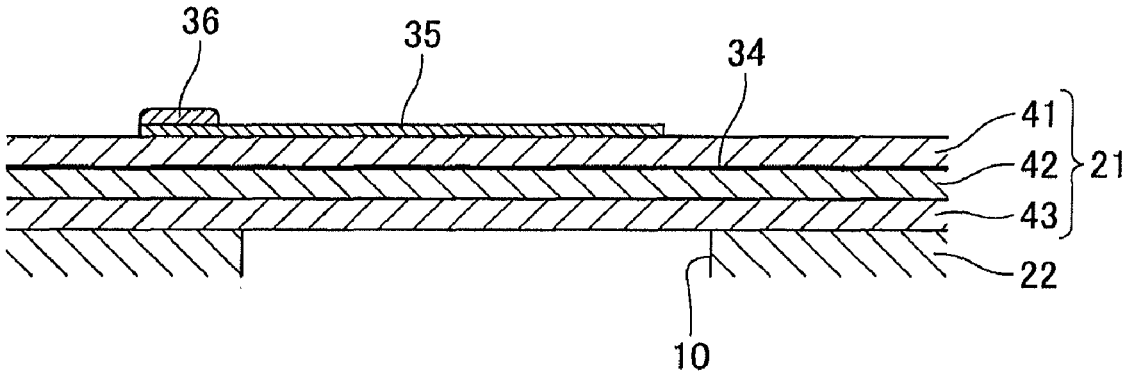
FIG. 6A is a partially-enlarged cross section of an actuator unit in the head.

As shown in FIG. 6A, each actuator unit 21 includes: a piezoelectric device formed by stacking and fixing three piezoelectric layers 41-43; an individual electrode 35 formed in an area of the upper surface of the piezoelectric layer 41 which area opposes the pressure chamber 10; and a common electrode 34 which is formed between the piezoelectric layer 41 and the piezoelectric layer 42 so as to entirely covers the surfaces of these layers 41 and 42. The piezoelectric layers 41-43 are made of a lead zirconate titanate (PZT)-base ceramic material having ferroelectricity.

Figure 6B:
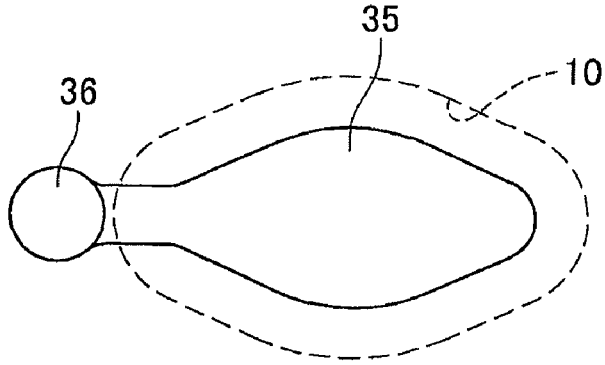
FIG. 6B is a plan view of an individual electrode in the actuator unit.

As shown in FIG. 6B, each individual electrode 35 is substantially rhombic in a plan view and similar to the pressure chamber 10. In a plan view, most part of the individual electrode 35 locates in the area of the pressure chamber 10. One acute portion of the individual electrode 35 is extended out from the pressure chamber 10, and a circular land 36 is provided at an end of this extended-out portion.

The common electrode 34 and the individual electrodes 35 are connected to the driver IC by respective wires of the COF 50. The common electrode 34 receives a signal kept at the ground potential from the driver IC. The individual electrodes 35 receive a drive signal from the driver IC. This drive signal alternates between the ground potential and a positive potential in accordance with an image pattern to be printed.

The piezoelectric layer 41 is polarized in its thickness direction. When the individual electrodes 35 and the common electrode 34 are arranged to have different potentials and an electric field is applied, in the polarization direction, to the portion (active portion) sandwiched between the electrodes 34 and 35, the active portion is deformed on account of the piezoelectric effect. For example, the active portion contracts in the direction orthogonal to the polarization direction (i.e. along the plane) when the polarization direction is identical with the direction of electric field application. On the other hand, the piezoelectric layers 42 and 43 are inactive layers which do not actively deform. Since the piezoelectric layers 41-43 are fixed to the upper surface of the cavity plate 22 defining the pressure chamber 10, unimorph deformation occurs (i.e. the portion equivalent to the active portion forms a convex shape protruding toward the pressure chamber 10). Such unimorph deformation provides pressure, i.e. ejection energy to the ink in the pressure chamber 10, with the result that the ink is ejected from the ejection opening 8. As such, the portion sandwiched between the individual electrode 35 and the pressure chamber 10 functions as an individual actuator. The actuator unit 21 has as many actuators as the pressure chambers 10.

Back to FIG. 1, the printer 1 is provided with a head elevating mechanism 9 (see FIG. 7) which moves, in the vertical direction C, the frame (not illustrated) to which the four heads 2 are fixed. The head elevating mechanism 9 moves the heads 2 in the direction C together with the frame, so that the distance between the conveying surface of the conveyor belt 63 and the ejection surfaces 2*a* of the heads 2 is changed. To eject ink from the ejection surfaces 2*a* to the printing surface of the sheet P for printing, the heads 2 are at the printing position (see FIG. 8A) where the gap between the ejection surfaces 2*a* and the conveying surface is narrow. The heads 2 are moved by the head elevating mechanism 9 to a position above the printing position only when a maintenance operation such as purging is carried out.

The printer 1 includes a movable board 64 and a fixed board 65 beside the conveyor mechanism 60. Each of the movable board 64 and fixed board 65 is a flat plate having a horizontal upper surface. The fixed board 65 is fixed to the housing of the printer 1. The movable board 64 is placed on the fixed board 65 so that the board 64 is able to reciprocate in the main scanning direction. The movable board 64 is able to move between the retracted position where the entire movable board 64 opposes the fixed board 65 and the maintenance position where the movable board 64 opposes the ejection surfaces 2*a* of the heads 2.

On the movable board 64, a substantially rectangular support 55 which extends in the sub-scanning direction is fixed near an end of the movable board 64 in the main scanning direction, which end is the closest to the heads 2 when the movable board 64 is at the retracted position. On the support 55, a wiper 56 is arranged in a standing condition along the sub-scanning direction, to wipe the ejection surfaces 2*a*. The wiper 56 is made of an elastic material such as resin and rubber, and is slightly longer in the sub-scanning direction than the total length of the four heads 2.

The printer 1 further includes a drive mechanism 66 for moving the movable board 64. The drive mechanism 66 includes a driven roller 67, a drive roller 68, a drive belt 69, and a drive motor 59 which drives the roller 68 (see FIG. 7). The rollers 67 and 68 are distanced from each other in the main scanning direction, and are able to rotate around the rotation shafts both of which extend in the sub-scanning direction. The drive belt 69 is stretched between the rollers 67 and 68. The movable board 64 is connected to the drive belt 69 by a protrusion 64*a*. The protrusion 64*a* juts in the sub-scanning direction from a side face of the movable board 64 which side face is perpendicular to the sub-scanning direction. The protrusion 64*a* is fixed to the bottom surface of the upper loop of the drive belt 69.

Figure 8A:
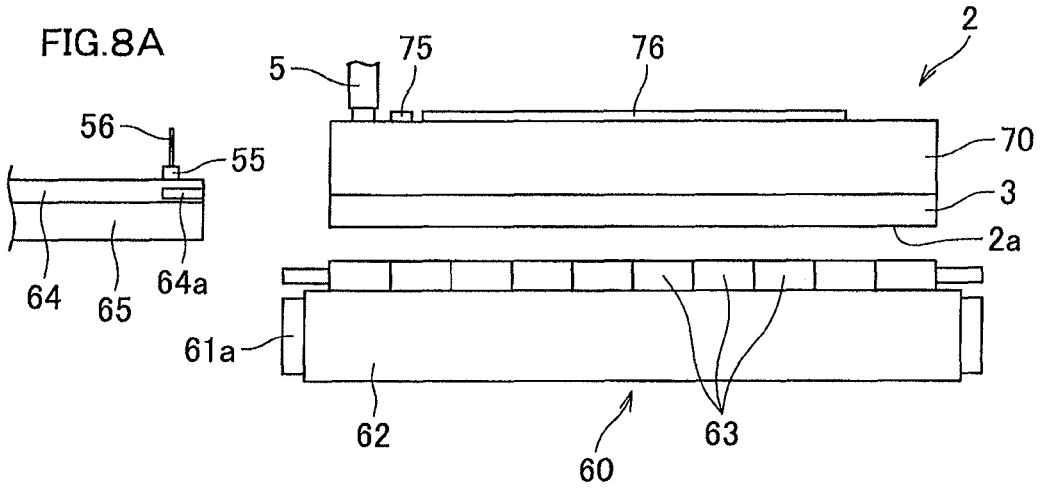
FIGS. 8A-8C explain the operations of the head and the movable board during the maintenance.
Figure 8B:
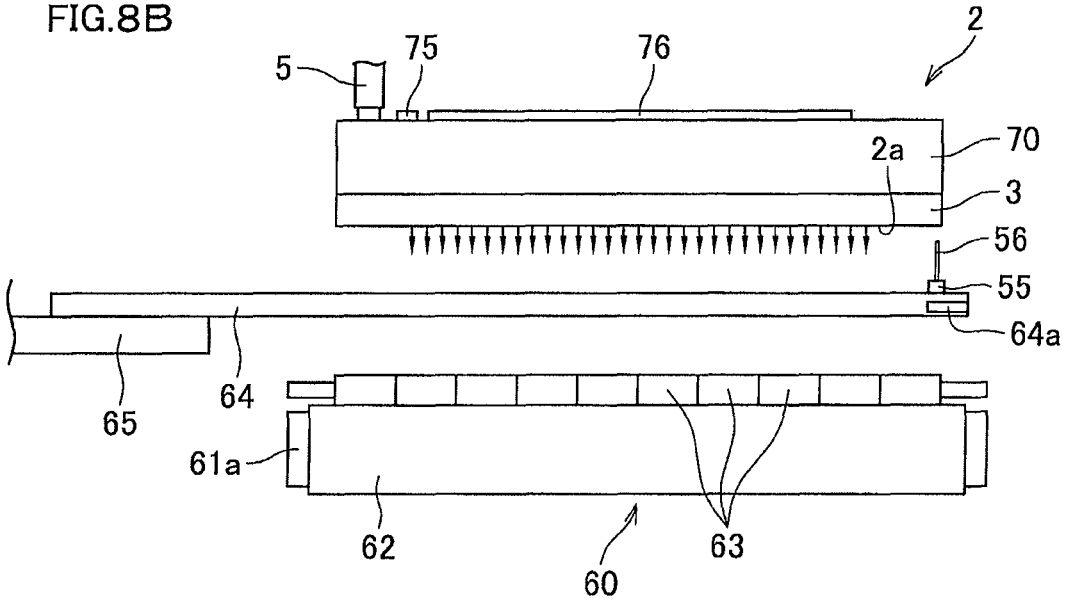
Figure 8C:
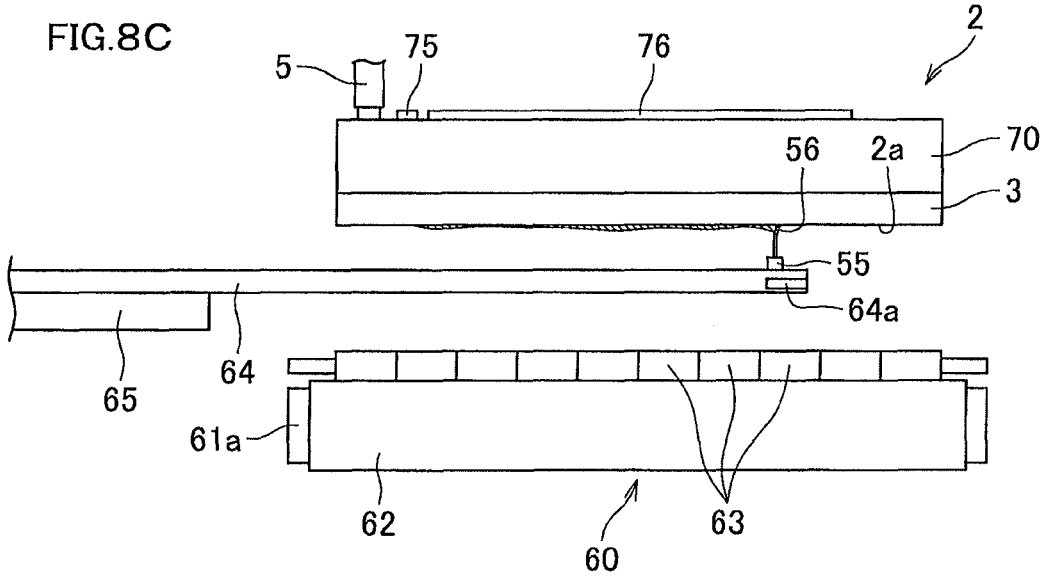

When the drive motor 59 drives under the control of the controller 100 and the roller 68 rotates in the forward direction, the drive belt 69 moves so that the movable board 64 moves from the retracted position to the maintenance position (see FIG. 8B). When the roller 68 rotates in the backward direction, the movable board 64 moves from the maintenance position to the retracted position (see FIG. 8C). After the movable board 64 reaches the maintenance position and before the board 64 starts to move toward the retracted position, the heads 2 are moved slightly downward by the head elevating mechanism 9 so that the leading end of the wiper 56 is above the ejection surfaces 2*a*. This allows the wiper 56 to wipe the ejection surfaces 2*a* as shown in FIG. 8C, while the movable board 64 moves from the maintenance position to the retracted position.

The controller 100 will be described next. The controller 100 is, for example, composed of a general-purpose personal computer. Such a computer has hardware such as a CPU (central processing unit), a ROM (read-only memory), a RAM (random access memory), and a hard disc. The hard disc stores various types of software including a program for controlling the operations of the components of the printer 1. The components 101-105 (see FIG. 7) of the controller 100 are constructed by combining these hardware and software.

Figure 7:
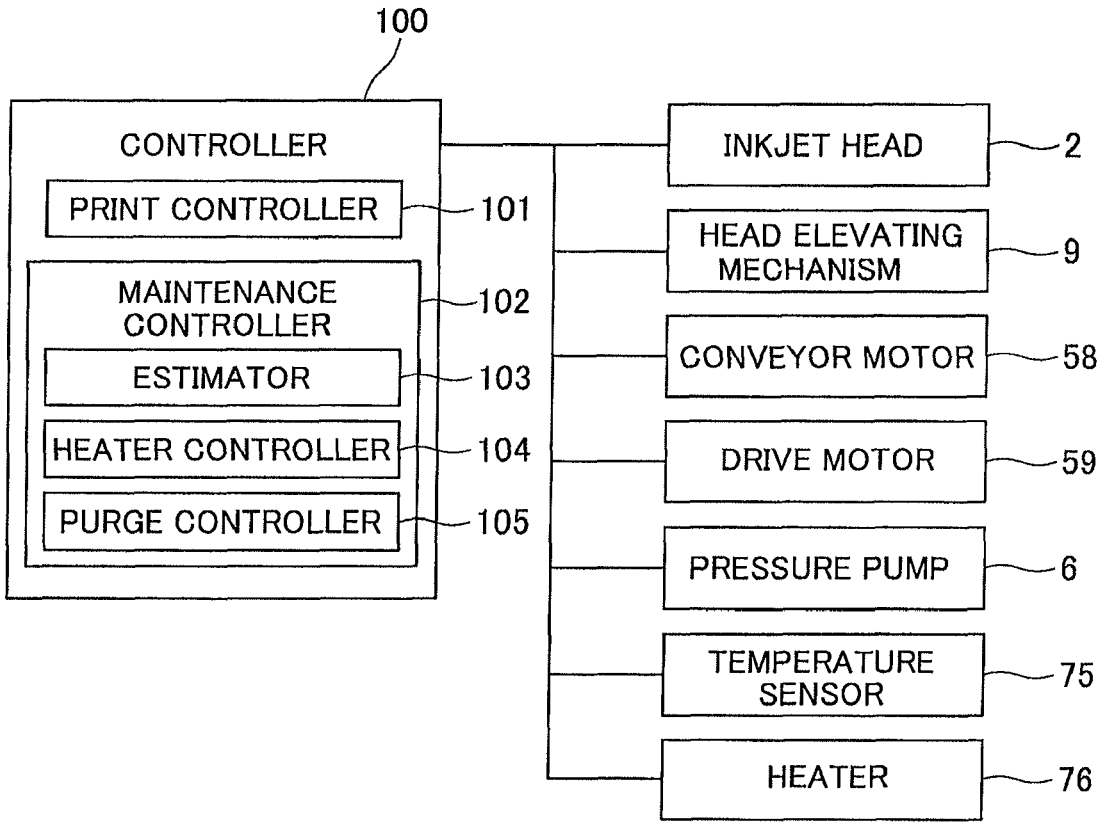
FIG. 7 is a block diagram which outlines the controller of the printer.

As shown in FIG. 7, the controller 100 includes a printing controller 101 and a maintenance controller 102.

The printing controller 101 controls the conveyor motor 58 so that the conveyor mechanism 60 conveys sheets P in the conveyance direction B. Also, the printing controller 101 controls the heads 2 in such a way that ink is ejected from the ejection opening 8 in sync with the conveyance by the conveyor mechanism 60.

The maintenance controller 102 includes an estimator 103, a heater controller 104, and a purge controller 105. The estimator 103 estimates the temperature of the ink in the reservoir 72*a* before the ink is heated by the heater 76, based on the ambient temperature detected by the temperature sensor 75. In the present embodiment, the estimator 104 estimates that the temperature of the ink in the reservoir 72*a* is lower by 5° C. than the ambient temperature detected by the temperature sensor 75.

When the ambient temperature detected by the temperature sensor 75 is lower than a first predetermined temperature (e.g. 30° C.), the heater controller 104 controls the heater 76 based on the temperature estimated by the estimator 103 so that the ink in the reservoir 72*a* is heated by the heater 76 to a second predetermined temperature (e.g. 25° C.). The second predetermined temperature is not higher than the first predetermined temperature and is, for example, a temperature with which the ink viscosity is at a desired level.

The purge controller 105 controls the head elevating mechanism 9 so that the heads 2 are selectively switched between the printing position and a position above the printing position. Also, the purge controller 105 controls the drive motor 59 such that the movable board 64 is selectively switched between the maintenance position and the retracted position.

When the ambient temperature detected by the temperature sensor 75 is not lower than the first predetermined temperature, the purge controller 105 continuously drives the pressure pump 6 until a predetermined amount (twice as much as the capacity of the reservoir 72*a* in the present embodiment) of ink is ejected from the ejection openings 8.

When the ambient temperature detected by the temperature sensor 75 is lower than the first predetermined temperature, the purge controller 105 intermittently drives the pressure pump 6 twice until a predetermined amount of ink is discharged from the ejection openings 8. An amount of ink discharged from the ejection openings 8 in response to a single driving action of the pressure pump 6 is half as much as the predetermined amount (i.e. equal to the capacity of the reservoir 72*a* in the present embodiment).

Now, the following will describe how the components of the printer 1 are controlled by the printing controller 101 during the printing process. First, as the controller 100 receives a printing instruction, the printing controller 101 controls the conveyor motor 58 so that a sheet P having been supplied from a sheet feed cassette (not illustrated) to the conveyor belt 8 is conveyed in the conveyance direction B.

The printing controller 101 then controls the heads 2 so that ink is ejected from the ejection openings 8 when the sheet P opposes each ejection surface 2*a*. As such, an image is formed on the sheet P. Subsequently, the printing controller 101 controls the conveyor motor 58 so that the movement of the conveyor belt 63 is stopped as the printed sheet P is stored in a sheet discharge tray (not illustrated). In this way, the printing on the sheet P by the printer 1 finishes.

Figure 9:
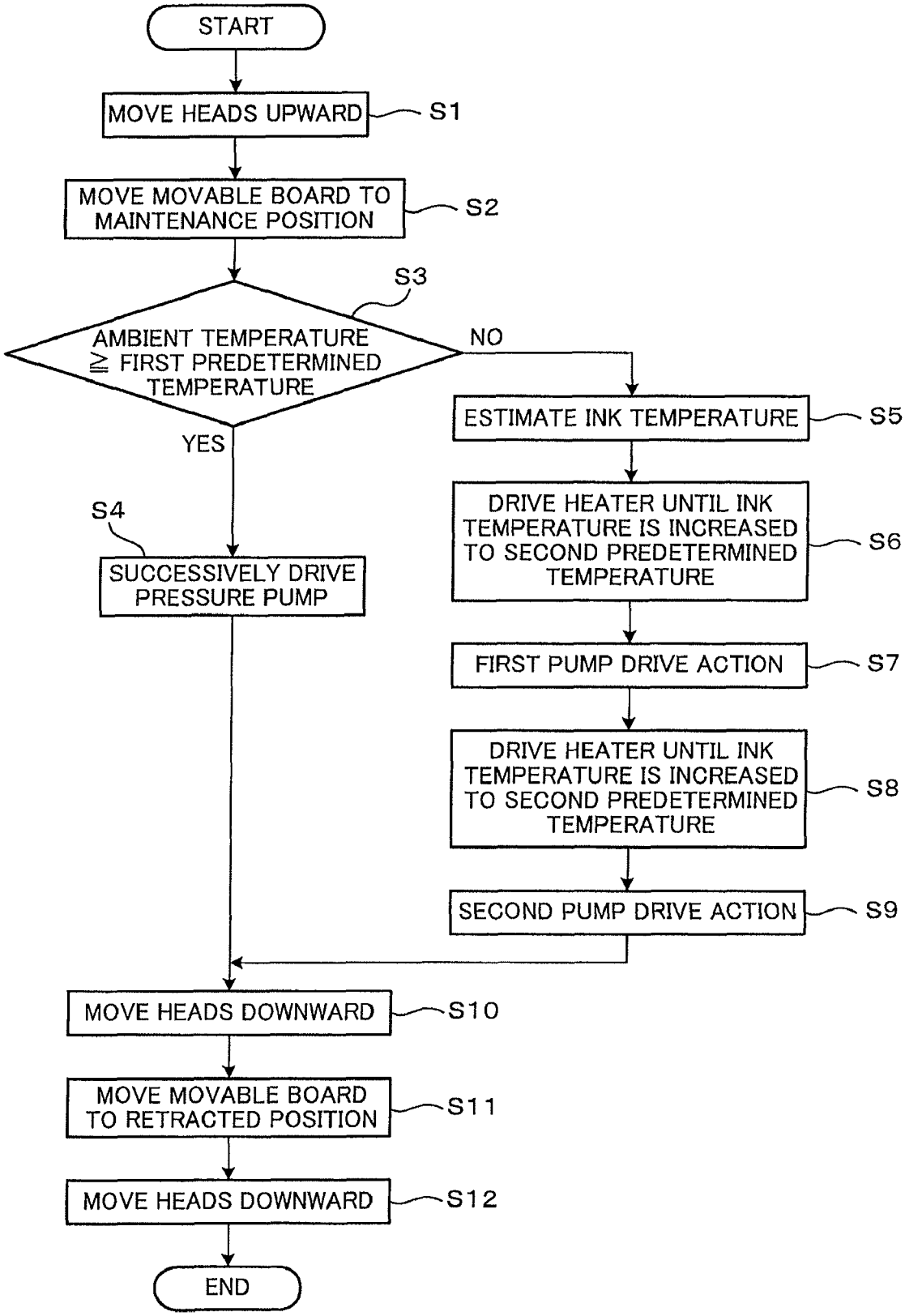
FIG. 9 is a control flow diagram during the maintenance, which is executed by the controller of the printer.

Referring to FIGS. 8 and 9, attention now turns to the control of the components of the printer 1 during the maintenance, which is carried out by the maintenance controller 102. In the present embodiment, the maintenance means that the ejection surfaces 2*a* after the purging are wiped by the wiper 56. The purging means that the ink in the ink flow paths of the heads 2 is pressurized by the pressure pump 6 so that the ink is forcibly ejected from the ejection openings 8. The purging is carried out to resolve or prevent the thickening and/or clogging of ink in the ejection openings 8.

As shown in FIG. 9, first of all the purge controller 105 controls the head elevating mechanism 9 so that the four heads 2 at the printing position shown in FIG. 8A are moved upward to a position shown in FIG. 8B where the ejection surfaces 2*a* are above the leading end of the wiper 56 (S1).

Subsequently, the purge controller 105 controls the drive motor 59 so that, as shown in FIG. 8B, the movable board 64 is moved from the retracted position to the maintenance position (S2). Since the heads 2 at this moment are located so that the ejection surfaces 2*a* are above the leading end of the wiper 56, the wiper 56 moves below the ejection surfaces 2*a* without contacting the same. Thereafter the purge controller 105 controls the pressure pump 6 in such a way that a predetermined amount of ink is ejected from the ejection openings 8 toward the movable board 64 by the pressure applied by the pressure pump 6. If in this situation the ambient temperature detected by the temperature sensor 75 is not lower than the first predetermined temperature (S3: YES), the purge controller 105 proceeds to S4. In S4, the purge controller 105 continuously drives the pressure pump 7 until the predetermined amount of ink is discharged from the ejection openings 8.

When the ambient temperature is lower than the first predetermined temperature (S3: NO), the estimator 103 estimates the temperature of the ink in the reservoir 72*a* before the ink is heated by the heater 76, with reference to the ambient temperature detected by the temperature sensor 75 (S5). Thereafter, the heater controller 104 drives the heater 76 only for a predetermined period of time based on the temperature estimated by the estimator 103 in S5, in such a way as to cause the ink in the reservoir 72*a* to be heated to the second predetermined temperature by the heater 76 (S6).

Subsequently, after the predetermined period of time, the purge controller 105 drives the pressure pump 6 to eject the ink from the ejection openings 8 half as much as the predetermined amount (S7). Then the pressure pump 6 is temporarily stopped. It is noted that ink flows from the ink tank to the reservoir 72*a* while the ink ejection of S7 is conducted, in order to make up for the loss of consumed ink discharged from the ejection openings 8.

Thereafter, the heater controller 104 drives the heater 76 only for a predetermined period of time based on the temperature estimated by the estimator 103 in S5, in such a way as to cause the ink (including those flowing from the ink tank in S7) in the reservoir 72*a* to be heated to the second predetermined temperature by the heater 76 (S8). The purge controller 105 resumes the drive of the pressure pump 6 when the temperature of the ink in the reservoir 72*a* reaches the second predetermined temperature (S9).

After the pressure pump 6 drives twice (S7 and S9), the predetermined amount of ink is purged from the ejection openings 8. Most of the ink discharged by this purging passes through the surface of the movable board 64 and flows into a waste ink tank (not illustrated). Some of the ink remain on the ejection surfaces 2*a* as ink droplets.

After S4 or S9, the purge controller 105 controls the drive motor 59 so that the four heads 2 are slightly moved downward to a position where the leading end of the wiper 56 is above the ejection surface 2*a* (S10). The purge controller 105 then controls the drive motor 59 so that the movable board 64 is moved from the maintenance position to the retracted position (S11). While these operations are carried out, as shown in FIG. 8C, the leading end and the part following thereto of the wiper 56 move while being bended by and in contact with one of the ejection surface 2*a*, with the result that the ink droplets remaining on the ejection surfaces 2*a* after the purging are wiped away.

After the movable board 64 returns to the retracted position, the purge controller 105 controls the drive motor 59 so that the four heads 2 descend to the printing position (S12). This is the end of the maintenance of the heads 2.

As discussed above, the printer 1 of the present embodiment is arranged so that the pressure pump 6 intermittently drives twice until a predetermined amount of ink is ejected, when the ambient temperature of the heads 2 is lower than a first predetermined temperature (S3 of FIG. 9: NO, see S7 and S9). An amount of ink ejected from the ejection openings 8 in response to a single driving action of the pressure pump 6 is half as much as the predetermined amount (in the present embodiment, as much as the capacity of the reservoir 72*a*). This amount is equal to the amount of ink heated by the heater 76 (i.e. equal to the capacity of the reservoir 72*a*). This makes it possible to certainly obtain the effect of the heating by the heater 76, i.e. the effects of lowering the viscosity of ink and restraining an increase of the resistance to ink from the path. Therefore the purging is properly carried out even if the ambient temperature is lower than the first predetermined temperature, without using an expensive pressurizer which is able to apply high pressure but increases the size of the head 2, and without increasing the cross section of the ink flow path of the head 2. On this account the cost of the pressurizer and the size of the head 2 are restrained. In other words, it is possible to adopt a pressure pump 6 which is inexpensive and does not increase the size of the head 2. Furthermore, since it is unnecessary to increase the size of the head 2, increase in the size of the printer 1 is also unnecessary.

If the resistance to ink from the path is high during the purging, the flow rate of the ink is low and hence bubbles in the ink flow path of the head 2 remain in the ink flow path because they are not ejected together with the ink. In this regard, the present embodiment is arranged so that the resistance to the path during the purging is restrained and the decrease in the flow rate of ink is restrained. The bubbles in the ink flow path of the head 2 are therefore effectively ejected during the purging.

Based on the temperature estimated by the estimator 103, the heater controller 104 increases the time duration to drive the heater 76 as the ambient temperature is lowered, and decreases the time duration to drive the heater 76 as the ambient temperature is increased. This makes it unnecessary to excessively heat the ink, with the result that the ink is efficiently heated while the cost for driving the heater 76, such as electric power cost, is restrained.

The purge controller 105 controls the pressure pump 6 so that the drive interval of the pressure pump 6 in S7 and S9 (i.e. a time between the end of one driving action and the start of the subsequent driving action) is equal to the time required for heating the ink to the second predetermined temperature by the heater 76, which ink is flown into the reservoir 72*a* from the ink tank for the purpose of making up for the loss of ink due to the prior drive. This prevents the drive interval of the pressure pump 6 from being unnecessarily long.

The higher the ambient temperature detected by the temperature sensor 75 is, the more a temperature of the ink in the reservoir 72*a* is closer to the second predetermined temperature and the shorter the time required for the heating is. Therefore the purge controller 105 controls the pressure pump 9 so that the drive interval of the pressure pump 9 in S7 and S9 is shortened as the ambient temperature is increased. This optimizes the drive interval in accordance with the ambient temperature and prevents the purging from taking unnecessarily long time.

The heater 76 heats the ink in the reservoir 72*a*. The reservoir 72*a* is located upstream of the outlet of the sub-manifold path 5*a* in the direction of the flow of the ink in the ink flow path toward the ejection openings 8. That is to say, when the ambient temperature is lower than the first predetermined temperature, the viscosity of the ink in the reservoir 72*a* is lowered by heating and the ink flows toward the individual ink flow path 32. In this way the resistance to the ink from the individual ink flow path 32 is restrained.

The heater 76 heats the ink in the reservoir 72*a* which has a large capacity. The heating is therefore effectively carried out with low cost, as compared to a case where the ink to be heated is in all paths constituting the ink flow path of the head 2 or a case where the ink to be heated is in a path whose capacity is small as compared to the other paths.

The printer 1 is not necessarily provided with the estimator 103. When the estimator 103 is not provided, the heater controller 104 may control the heater 76 based on not a temperature estimated by the estimator 103 but the ambient temperature.

The heater controller 104 may control the heater 76 so that the ink in the reservoir 72*a* has any temperature higher than the temperature estimated by the estimator 103 (for example, the ink has a temperature lower than the second predetermined temperature and not lower than the first predetermined temperature). As long as the ink temperature is hither than the temperature estimated by the estimator 103, the resistance to the ink from the path is restrained. In particular, the viscosity of the ink is further lowered when the ink temperature is not lower than the first predetermined temperature, and hence the resistance from the path is further restrained.

The drive interval of the pressure pump 6 (i.e. the time between the end of one driving action and the start of the subsequent driving action) may be arranged to be constant. In this case, it is preferable that the power supplied to the heater 76 is lowered as the ambient temperature increases, in consideration of the reduction of power consumption.

The present invention is also applicable to a case where the ink to be heated is in all paths constituting the ink flow path of the head 2 and a case where the ink to be heated is in a path (which is not the reservoir 72*a*) whose capacity is small as compared to the other paths. In other words, the ink to be heated by the heater 76 may be stored in any part of the ink flow path of the head. In addition, there is no particular limitation to the position of the heater 76.

The ink flow path in the head 2 may include another component in addition to the reservoir 72*a*, the manifold path 5, the sub-manifold path 5, and the individual ink flow path 32, and may be arranged in many different manners.

The predetermined amount of ink ejected in the purging is not limited to the amount twice as much as the capacity of the reservoir 72*a*. The predetermined amount may be more than or less than the above amount.

The purge controller 105 controls the pressure pump 6 so that, when the ambient temperature is lower than the first predetermined temperature, an amount of ink ejected in response to a single driving action of the pressure pump 6 is lower than an amount of ink heated by the heater 76, and the pressure pump 6 is intermittently driven a plurality of times (not limited to twice) until the total amount of ejected ink reaches a predetermined amount.

The pressurizer is not necessarily the pressure pump 6. Alternatively, the pressurizer may be a suction mechanism by which ink is sucked to the outside of the heads 2 through the ejection openings 8. The effects of the embodiment are achieved also in this case, as long as the purge controller 105 controls the suction mechanism in a similar manner as the pressure pump 6.

The head of the present invention may eject liquid which is not ink.

The present invention is applicable to not only the color printer of the embodiment above but also a serial printer, black-and-white printer, or the like. In addition, the actuator is not limited to the piezoelectric type. An alternative for example is a thermal type.

The present invention is applicable to not only inkjet printers such as that of the embodiment above but also various types of liquid ejection apparatuses. Examples of such apparatuses include an apparatus which ejects conductive paste to form a fine wiring pattern on a substrate, an apparatus which ejects an organic light emitter onto a substrate so as to form a high-definition display, and an apparatus which ejects optical resin onto a substrate to form a fine electronic device such as an optical waveguide.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejection apparatus comprising:

a head which has a plurality of ejection openings from which liquid is ejected and a liquid path which is connected to the ejection openings and formed inside the head;

a pressurizer which pressurizes liquid in the liquid path of the head;

a temperature sensor which detects an ambient temperature of the head;

a heater which heats liquid in at least a part of the liquid path;

a heater controller which controls the heater so that the liquid is heated by the heater when the ambient temperature detected by the temperature sensor is lower than a first predetermined temperature; and a purge controller which controls the pressurizer so that (i) the pressurizer is continuously driven until a predetermined amount of liquid is ejected from the ejection openings, when the ambient temperature detected by the temperature sensor is not lower than the first predetermined temperature and (ii) the pressurizer is intermittently driven a plurality of times until the predetermined amount of liquid is ejected from the ejection openings, when the ambient temperature detected by the temperature sensor is lower than the first predetermined temperature, an amount of liquid ejected from the ejection openings in response to a single driving action of the pressurizer being not larger than an amount of liquid heated by the heater.

2. The liquid ejection apparatus according to claim 1, further comprising:

an estimator which estimates a temperature of the liquid before the liquid is heated by the heater, based on the ambient temperature detected by the temperature sensor, wherein, the heater controller controls the heater based on the temperature estimated by the estimator so that the liquid is heated by the heater to a second predetermined temperature which is lower than the first predetermined temperature.

3. The liquid ejection apparatus according to claim 2, wherein, the purge controller controls the pressurizer so that, when the ambient temperature is lower than the first predetermined temperature, an interval between two driving actions of the pressurizer is equal to time required for heating, to the second predetermined temperature by the heater, liquid which flows into the liquid path accompanied by liquid ejection from the ejection openings on a single driving action of the pressurizer.

4. The liquid ejection apparatus according to claim 1, wherein, the purge controller controls the pressurizer so that, when the ambient temperature is lower than the first predetermined temperature, an interval between two driving actions of the pressurizer is shortened as the ambient temperature is increased.

5. The liquid ejection apparatus according to claim 1, wherein, the liquid path of the head includes:

a reservoir which temporarily stores liquid supplied from a liquid supply source;

a common liquid path connected to the reservoir; and a plurality of individual liquid paths which link an outlet of the common liquid path with the respective ejection openings, and include a partial path whose resistance to liquid is higher than the reservoir and the common liquid path, and the heater heats liquid which is located upstream of the outlet of the common liquid path, in the direction of flow of liquid in the liquid path toward the ejection openings.

6. The liquid ejection apparatus according to claim 5, wherein, the reservoir has a larger capacity than the common liquid path, and the heater heats liquid in the reservoir.

* * * * *